US007709435B2

(12) United States Patent
Hino et al.

(10) Patent No.: US 7,709,435 B2
(45) Date of Patent: May 4, 2010

(54) ALKALINE CLEANING LIQUID COMPRISING METALLIC IONS FOR ALUMINUM OR ALUMINUM ALLOYS AND METHOD OF CLEANING

(75) Inventors: Kazuya Hino, Tokyo (JP); Yasuo Iino, Tokyo (JP); Ryoji Morita, Tokyo (JP); Akio Shimizu, Tokyo (JP); Kazuhisa Masuda, Kanagawa (JP); Shozo Ichinose, Kanagawa (JP); Shozo Sakurama, Osaka (JP)

(73) Assignees: Nihon Parkerizing Co., Ltd., Tokyo (JP); Tokyo Seikan Kaisha Ltd., Tokyo (JP)

( * ) Notice: Subject to any disclaimer, the term of this patent is extended or adjusted under 35 U.S.C. 154(b) by 511 days.

(21) Appl. No.: 10/569,495

(22) PCT Filed: Aug. 27, 2004

(86) PCT No.: PCT/JP2004/012382
§ 371 (c)(1),
(2), (4) Date: Dec. 4, 2006

(87) PCT Pub. No.: WO2005/026411
PCT Pub. Date: Mar. 24, 2005

(65) Prior Publication Data

US 2007/0184997 A1 Aug. 9, 2007

(30) Foreign Application Priority Data

Aug. 29, 2003 (JP) ..... 2003-305774
Apr. 14, 2004 (JP) ..... 2004-118500

(51) Int. Cl.
*C11D 3/04* (2006.01)
*C11D 3/36* (2006.01)
*C11D 3/10* (2006.01)

(52) U.S. Cl. ..... 510/254; 510/255; 510/245; 510/248; 510/252; 510/272; 510/363; 510/431; 510/436; 510/467; 510/478

(58) Field of Classification Search ..... 510/254, 510/255, 245, 248, 252, 272, 363, 431, 436, 510/467, 478
See application file for complete search history.

(56) References Cited

U.S. PATENT DOCUMENTS

| | | | | |
|---|---|---|---|---|
| 4,446,035 | A * | 5/1984 | Barrat et al. | 510/335 |
| 5,294,364 | A * | 3/1994 | Thomas et al. | 510/101 |
| 5,382,295 | A * | 1/1995 | Aoki et al. | 134/2 |
| 5,472,629 | A * | 12/1995 | Lysy et al. | 510/238 |
| 6,177,396 | B1 * | 1/2001 | Clapperton et al. | 510/405 |
| 6,380,410 | B1 * | 4/2002 | Oftring et al. | 554/149 |
| 6,903,060 | B1 * | 6/2005 | Dykstra et al. | 510/314 |
| 2003/0203466 | A1 * | 10/2003 | Kauppinen et al. | 435/200 |
| 2004/0068051 | A1 * | 4/2004 | Ortiz et al. | 525/54.1 |
| 2006/0089284 | A1 * | 4/2006 | Miracle et al. | 510/320 |
| 2006/0234893 | A1 * | 10/2006 | Busch et al. | 510/376 |
| 2007/0068557 | A1 * | 3/2007 | Ortiz et al. | 134/26 |

FOREIGN PATENT DOCUMENTS

| | | | |
|---|---|---|---|
| JP | 50-1689 | B1 | 1/1975 |
| JP | 4-187788 | A | 7/1992 |
| JP | 9-111465 | A | 4/1997 |
| JP | 2001-064700 | * | 3/2001 |
| JP | 2001-64700 | A | 3/2001 |

* cited by examiner

*Primary Examiner*—Charles I Boyer
(74) *Attorney, Agent, or Firm*—Birch, Stewart, Kolasch & Birch, LLP

(57) ABSTRACT

There is provided an alkaline cleaning of aluminum alloy, in which the attained corrosion resistance is equal or superior to the acidic cleaning agent, and which mitigates the disadvantages of the acidic cleaning agent, such as corrosion of plant, processing of the waste liquid, and energy cost, and which attains improved productivity.

The cleaning liquid from 0.5 to 40 g/L in total of one or more alkali builders selected from alkali metal hydroxide, alkali metal carbonate, inorganic alkali metal phosphate and alkali metal silicate, from 0.2 to 10 g/L of one or more of organic phosphonic acid and its salt (A), from 0.001 to 2 g/L of one or more metallic ions (B) selected from metallic ions having from 5.0 to 14.0 of stability constant with the organic phosphonic acid and its salt, and from 0.1 to 10 g/L of surfactant. Particularly, the weight ratio of (A):(B) is in a range of from 100:0.05~20.

8 Claims, 1 Drawing Sheet

ALKALINE CLEANING LIQUID COMPRISING METALLIC IONS FOR ALUMINUM OR ALUMINUM ALLOYS AND METHOD OF CLEANING

TECHNICAL FIELD

The present invention relates to an alkaline cleaning liquid and a method for cleaning and removing such contaminants as fine powder of aluminum alloy generated during forming and oil adhered on the surface of the formed articles of an aluminum or aluminum alloy rolled sheet, and its formed articles such as cans, containers and the like.

BACKGROUND TECHNIQUE

Generally, aluminum and aluminum alloys are formed into a desired shape for application by means of rolling, pressing and the like. For example, a container of aluminum or aluminum alloy (hereinafter referred to as "aluminum container") is usually formed into a can by means of drawing, which is referred to as drawing and ironing. The forming lubricant adheres on the surface of the aluminum cans shaped by the forming method mentioned above. Additionally, such contaminants as fine powder generated during the forming and the like adhere on the surface. These contaminant materials are inconvenient for the subsequent surface treatments and paint coating and hence are removed by various cleaning. It is known that superiority or inferiority of the cleaning property exerts significant influence upon the surface treatments and quality of the paint coating.

The cleaning liquid, which is commercially used at present to clean the aluminum container, is a sulfuric-acid aqueous solution, which contains hydrofluoric acid and one or more surfactants, or an aqueous solution, which contains phosphoric acid, nitric acid, ferric iron and sulfuric acid, as well as one or more surfactants. These acidic cleaning liquids are very effective and have a number of advantageous features.

However, the equipment of the cleaning line of aluminum formed articles usually made of stainless steel and other steels is disadvantageously corroded by these acidic cleaning liquids. Manpower and high cost are, therefore, necessary for the maintenance of the cleaning line. In addition, the waste liquid containing hydrofluoric acid and aluminum fluoride raises environmental problems in the treatment of waste liquid containing fluorine. Furthermore, the cleaning liquid, which contains trivalent iron necessitates treatment at high temperature exceeding 70° C. and raises energy problem.

Heretofore, several alkaline cleaning liquids for the aluminum container have been proposed to solve the problems described hereinabove. In Patent Documents 1 through 5, particular compositions of the alkaline cleaning liquid have been proposed, but the industrial property is unsatisfactory. It has also been proposed to pickle after alkaline cleaning or to alkaline clean with the proviso that a neutralizing process using acidic liquid is carried out. In every case, mass production technique in industry scale is not at all established. This is because, although the pickling process introduced subsequent to the alkaline cleaning dissolves a thickly grown oxide film in the alkaline cleaning and is effective and necessary for preventing discoloration and improving the paint adherence, the existing plant and the like imposes a limitation on the use of pickling.

The alkaline cleaning liquid proposed in Patent Document 5 has a particular composition consisting of one or more alkaline builders, at least one compound selected from aminoalkyl diphosphonic acid and hydroxyalkyl diphosphonic acid, and at least one aluminum-ion blocking agent selected from alkali metal salt of gluconic acid, alkali metal salt of oxalic acid, alkali metal salt of tartaric acid, or sorbitol, and surfactant. The technique proposed is to suppress growth of oxide film on the surface of an aluminum container to be cleaned or to suppress the segregation of Mg. The pickling process is not necessary.

However, this technique does not intend to apply to industrial continuous production. Incidentally, no appropriate method of controlling alkaline cleaning liquid capable of practical application has been provided. Therefore, the level of technique at the time of 1993 roughly targeted the use the alkalinity and surface tension (Non Patent Document 1).

However, it was discovered that the alkaline cleaning liquid disclosed in Patent Document 5 is strongly influenced by the particular metal-ion component incorporated in the liquid. It was discovered that the behavior and condition of the particular metal-ion components during the industrial continuous production are as follows. Specifically, the particular metal-ion components are already present in the water used for the cleaning liquid or dissolve from the aluminum alloy. The amount of particular metal-ion components varies. Variation in the amount of the particular metal-ion components is the reason why etching-stability and uniformity cannot be continuously maintained. Particularly, local corrosion of the aluminum container is liable to occur in the cleaning (hereinafter referred to as "pitting corrosion"). This is a serious drawback that may cause the can's flange to crack.

In addition, in the production line, the alkaline cleaning liquid may be discarded or replenished at the time of plant maintenance and the like. After discarding, alkaline cleaning liquid is prepared fresh and the continuous production is started. Along with treatment of aluminum alloy, a constant portion of the alkaline cleaning liquid is discarded, and fresh cleaning liquid, which compensates for the discarded amount, is added in the continuous production. During the alkaline cleaning, the particular metal-ion components, which dissolve along with treatment of aluminum alloy, continuously increase and then reaches in the saturation state in a certain period. The period, in which the concentration of particular metal-ion components arrives at saturation state in the alkaline cleaning liquid, is determined by the size of a vessel for storing the alkaline cleaning liquid is, and the discarding and replenishing amounts mentioned above. In most of the lines, approximately 10 hours is necessary to reach the saturation state. There is a possibility that the concentration of particular alloy-components varies during 10 hours mentioned above, so that the constant property is not attained. Several of the treated aluminum containers may not be commercially accepted. The aluminum containers produced in such period may be 500,000 or more, which is a very disadvantageous production result.

Patent Document 1: Japanese Unexamined Patent Publication (kokai) Sho 59-133382

Patent Document 2: Japanese Patent No. 2587916

Patent Document 3: Japanese Unexamined Patent Publication (kokai) Sho 62-247090

Patent Document 4: Japanese Unexamined Patent Publication (kokai) Sho 62-182291

Patent Document 5: Japanese Unexamined Patent Publication (kokai) Hei4-187788

Non-patent Document 1: NP Series "Surface Cleaning Techniques" published by Maki Shoten on Nov. 10, 1993 (first edition) and Oct. 10, 1998 (first edition and second print), page 91

DISCLOSURE OF INVENTION

Problems to be Solved by Invention

The present invention is to solve the problems mentioned above concerning the drawbacks of the conventional alkaline cleaning liquids, and provides an alkaline cleaning liquid and a cleaning method of aluminum and aluminum alloy. The provided liquid and method: attain corrosion resistance equal to or superior to that of the acidic cleaning liquid; also mitigate the drawbacks of the acidic cleaning liquid, such as the corrosion of a plant, treatment of the waste liquid and thermal energy cost; and improve the production stability.

Means for Solving Problem

The present inventors extensively considered ways for solving the problems involved in the conventional aluminum alkaline-cleaning and encountered in the industrial continuous production and reached the following conclusions. A role of the organic phosphonic acid and its salt resides lies in blocking, prior to cleaning, the alloying components present on the surface of aluminum or aluminum alloy, or blocking decomposition of the alloy components present in the metal soap, thereby realizing uniform etching. In order to maintain continuous and uniform etching, the ratio of the metal ions to the organic phosphonic acid and its salt is preferably within the range of claim 2, which metal ions have a specific stability constant with respect to the organic phosphonic acid and its salt. The principle of the alkaline cleaning liquid according to claim 2 is described with reference to FIG. 1.

In zone A of FIG. 1, the particular metal ions relative to the organic phosphonic acid and its salt are less than a predetermined amount. In this zone, the etching amount is large, but the aluminum or aluminum-alloy surface is not etched uniformly, so that pitting corrosion and hence the flange crack are incurred. Thus, continuous and uniform etching cannot be maintained.

In Zone B of FIG. 1, the etching amount is constant no matter how the ratio of metal ions varies, and hence uniform etching can be maintained. This phenomenon is referred to as "the chelating buffer effect".

In Zone C of FIG. 1, the ratio of metal ions exceed a particular range. In this zone, the etching amount is low. The organic phosphonic acid and its salt cannot realize their functions, so that etching uniformity is poor and smut-removal properties are impaired.

According to the present invention, no matter how the particular metallic ion components vary within a predetermined range in the continuous production, stable etching uniformity can be maintained and aluminum-formed articles of improved quality can produced.

Specifically, the etching uniformity is improved, the pitting corrosion is suppressed, and various problems involved in the prior art can be solved by means of subjecting the aluminum or aluminum-alloy surface to spraying of or immersing, for 2 to 120 seconds, in an aluminum- or aluminum alloy-cleaning alkaline liquid, which is characterized by containing from 0.5 to 40 g/L in total of one or more alkali builders selected from alkali metal hydroxide, alkali metal carbonate, inorganic alkali metal phosphate and alkali metal silicate, from 0.2 to 10 g/L of one or more of organic phosphonic acid and its salt, from 0.001 to 2 g/L of one or more metallic ions selected from metallic ions having from 5.0 to 14.0 of stability constant with the organic phosphonic acid and its salt, and from 0.1 to 10 g/L of a surfactant, and which is adjusted at pH 9.0 to 13.0 and 30 to 70° C.

The source of alkali metal salt consists of hydroxide, carbonate, organic phosphate and silicate of potassium and sodium. For example, sodium hydroxide, sodium carbonate, potassium hydroxide, potassium carbonate, sodium phosphate, sodium metasilicate and the like are listed. At least one or more of these compounds can be used. Their combination of compounds in the formulation is not limited at all. However, from the viewpoint of sludge generation, the potassium salts are desirable. Particularly, potassium salt is present in 60% or more of molar ratio of the components. An appropriate content of the alkali salt is from 0.5 to 40 g/L in total. A preferable content is from 1.0 to 10.0 g/L. When the content is less than 0.5 g/L, the etching is insufficient and the aluminum surface becomes inhomogeneous. When the content is more than 40 g/L, the alkali metal salt attains no additionally improved etching and cleaning properties. Moreover, the aluminum surface is disadvantageously roughened due to excessively etching.

Aminotrimethylene phosphonic acid or ethylenediamine tetramethylene phosponic acid and hydroxyalkyl diphosphonic acid, such as 1-hydroxy ethylidene-1,1 diphosphonic acid are listed as a supply source of the organic phosphonic acid. Appropriate content is from 0.2 to 10.0 g/L, and a preferable content is from 1.0 to 5.0 g/L. At a content less than 0.2 g/L, there is no appreciable effect of suppressing smut. On the other hand, at a content more than 10.0 g/L, no outstanding effects are recognized and the cost disadvantageously increases.

Manganese ion, magnesium ion, calcium ion, iron ion, zinc ion and copper ion are preferable as the metallic ions having from 5.0 to 14.0 of stability constant with the organic phosphonic acid and its salt. Sulfate, carbonate, phosphate, nitrate and the like can be used as the supply source of the metallic ions mentioned above, which are not at all limitative. The metal ions in the water used and the metal ions, which dissolve from the aluminum-alloy material during operation are also effective. One or more of the metallic ions may be contained. Stable effects are attained due to the chelating buffer effect, as long as the stability constant with the organic phosophonic acid and its salt is from 5.0 to 14.0. When the stability constant is less than 5.0, etching uniformity is not attained continuously. When the stability constant is more than 14.0, the smut-removing property is impaired. The stability constant with organic phosphonic acid and its salt is obtained by a titration method described for example in "Introduction to Chelate Chemistry" second revised edition, written by Yoshihei, UENO, pp 67-78. An appropriate content is from 0.001 to 2 g/L, and a preferable content is from 0.1 to 1 g/L. When the total amount of the metallic ions is less than 0.001 g/L, the metallic ions and the organic phosphonic acid and it salt exhibit unsatisfactory chelate buffer effects so that etching uniformity is not provided. When the content is more than 2 g/L, the smut removing effect is disadvantageously unsatisfactory.

In a case where a blocking agent of aluminum ions is contained, one or more of gluconic acid, heptogluconic acid, glycolic acid, oxalic acid, citric acid, tartaric acid, malonic acid, formic acid, glutaric acid, propyonic acid, succinic acid, malic acid, lactic acid, acetic acid, and benzoic acid are listed. One or more of these compounds can be used. The blocking agent is not particularly limited to these compounds. An appropriate content is from 0.1 to 10.0 g/L, and a preferable content is from 0.5 to 5.0 g/L. When the content is less than 0.1, effectiveness to block the aluminum ions dissolved from the aluminum surface is so weak that such precipitates as sludge may be formed due to accumulation of the aluminum ions. When the content is more than 10.0 g/L, there is no appreciable effects and the cost disadvantageously increases.

The surfactant is not limited to cationic surfactant, anionic surfactant or nonionic surfactant. The nonionic surfactant comprises ethylene oxide adduct and/or propylene oxide adduct of alkyl alcohol from the viewpoint of environment. An appropriate content is from 0.1 to 10.0 g/L, and a preferable content is from 0.5 to 5.0 g/L. At less than 0.1 g/L, degreasing property is unsatisfactory. Water wetting is so unsatisfactory that the paint coating peels. At more than 10.0 g/L, there are appreciable no effects. In addition, foaming occurs disadvantageously in the water-rinsing tank after degreasing.

In order to facilitate control of the concentration of the alkaline cleaning liquid according to the present invention, a constant amount of aluminum ions may be preliminarily present in the cleaning liquid. The concentration of the cleaning liquid is maintained at constant in the production line usually using an equipment referred to as the automatic concentration controller. A broadly used method is, for example, control of electric conductivity. This method is also effective for the alkaline cleaning liquid according to the present invention. In the continuous production using the alkaline cleaning liquid according to the present invention, aluminum ions dissolve from the aluminum or aluminum alloy and accumulate in the cleaning agent and saturate at a constant amount. This amount is generally from 200 to 2000 mg/L of aluminum ions and is dependent upon the characteristics of the production line. The concentration of the alkaline cleaning agent according to the present invention can be controlled by electric conductivity, under the state that the aluminum ions saturate. However, it is difficult to control the concentration of the essential components of the alkaline cleaning liquid with the aid of electric conductivity, when the condition of such liquid shifts from the almost aluminum ion-free state to that containing a large amount of the aluminum ions. This is because a large difference in the electric conductivity stems from the difference in the aluminum-ion concentration. Such phenomenon occurs, for example, when the cleaning liquid is discarded and production is re-started by preparing fresh cleaning liquid in the production line. This problem can be solved by means of preliminarily adding an amount of aluminum ions equivalent to the saturation amount in the production line. The method for adding aluminum ions is not limitative at all.

BEST MODE FOR CARRYING OUT INVENTION

The effects of the present invention are described more specifically with reference to the several examples and comparative examples given below. The tested materials, testing conditions and testing methods are as follows.

(1) Tested Materials

An aluminum sheet of JIS A3004 was DI worked to produce fifty un-cleaned containers (cans 66 mm ϕ×124 mmH).

(2) Testing Conditions

Features of the Cleaning Liquid according to the present invention lies in improved treating stability in the continuous production. The property of the Cleaning Liquid according to the present invention is evaluated with regard to the alkaline cleaning liquid, which has just been prepared, and the alkaline cleaning liquid, which has been subjected to application load, that is, which has been subjected to cleaning of a predetermined number of aluminum containers. That is, it can be said that the continuous treating property is improved, when the improved property of the alkaline cleaning liquid is attained both before and after application of operation load. Treating quantity of the containers mentioned above was set such that approximately 1000 mg/L of the aluminum ions dissolve into the alkaline cleaning liquid being tested, for the following reasons. In the case of cleaning the containers mentioned above in the actual production line, the saturation concentration of aluminum ions is from approximately 500 to 1500 mg/L. This fact was taken into consideration for setting the dissolving concentration of aluminum ions.

The treating process is described hereinafter. First, an evaluation can is prepared by the alkaline cleaning liquid, which is before application of the operation load, according to the treating process [1]. This procedure is as follows. (a) A DI worked but un-cleaned container is cleaned by means of spraying the alkaline cleaning liquid according to the present invention. (Temperature, time and details of the alkaline cleaning liquid are described in the examples). (b) Subsequently, city water was sprayed for 20 seconds to rinse out the alkaline cleaning liquid. (c) Subsequently, de-ionized water was sprayed at 20 seconds. (d) Drying was, then, carried out for 2 minutes in a hot-blast drying oven set out 200° C.

Subsequently, one hundred cans (DI worked aluminum containers) per 1 liter were cleaned under the conditions shown in the treating process [2]. Approximately 1000 mg/L of aluminum ions dissolve into the alkaline cleaning liquid by the operation mentioned above. Cleaning of the aluminum containers leads to decreased pH of the alkaline cleaning liquid. The pH was always monitored and was adjusted to maintain the initial value by potassium hydroxide. The operation load was, then, applied to the alkaline cleaning liquid by the treating process [2]. The alkaline cleaning liquid, to which the operation load has been applied as above, was used to prepare an evaluation can by the method of the treating process [1].

As a result of the application of the operation load, also the alloying elements contained in the aluminum material dissolve into the alkaline cleaning liquid together with aluminum. The quantity of the metal ions contained in the alkaline cleaning liquid was measured by the high-frequency inductively coupled plasma spectroscopy analysis (ICP). The metal ions measured were Ca, Mg, Mn, Fe, Zn and Cu, which have 5.0 to 14.0 of stability constant with respect to the organic phosphonic acid and its salt. These metals were quantitatively determined and the total amount of the metals is shown.

Process [1]: Assuming Prior to Continuous Operation (a) Degreasing (b) Water Rinsing (spraying for 20 seconds)

(c) Rinsing by Deionized Water (spraying for 20 seconds)

(d) Drying (200° C., 2 minutes, hot air)

Process [2]: Assuming During Continuous Operation (e) Dissolving (ten cans×100 batches×60 seconds: assuming the continuous operation)

(e) Degreasing (f) Water Rinsing (spraying for 20 seconds)

(g) Rinsing by Deionized Water (spraying for 20 seconds)

(h) Drying (200° C., 2 minutes, hot air)

(3) Testing Method of Property and Property Qualification as well as Evaluation

Smut Removal

Drying was carried out under the fourth item of Processes [1] and [2]. An identical adhesive tape was, then, applied on and peeled from three positions on the inner side surfaces of the post-dried container. Smut left on the adhesive tape was observed by the naked eye and evaluated by a standard that five points correspond to the full grade.

No left smut, (excellent) ○-Δ-X (inferior, left smut is present)

Water Wettability

Water rinsing was carried out under the second item of Processes [1] and [2]. After completion of the water rinsing, the container stood was stood for 30 seconds.

Water wetting area in % at this state was evaluated.

Adhesivity of Paint Coating

Drying was carried out under the fourth item of Processes [1] and [2]. An epoxy-urea paint coating was applied at 215° C. for 3 minutes (5μ of coating thickness). Cross cuts were formed on the inner surface of the containers. The containers were then immersed in boiling liquid for 60 minutes. The containers were then left to dry. Tape peeling was then carried out. The degree of peeling was evaluated by the naked eye.

Non peeling (excellent) ○-Δ-X (inferior) entire peeling on the surface of the tested portions.

<Testing Liquid>

Sodium Chloride 5 g/liter deionized water

Citric Acid 5 g/liter deionized water

Retention Appearance

After Processes [1] and [2], the drum and bottom portions were observed by the naked eye to detect non-uniform treatment.

No non-uniform treatment (excellent) ○-Δ-X (inferior) non-uniform treatment

Etching Uniformity

After Processes [1] and [2], the outer bottom surface of a container was observed by SEM (scanning type electron microscope) at 10000 times of magnification. An SEM photo 10 cm×6.7 cm in size was taken and was evaluated by naked eyes to find a number of pits due to local etching.

Number of pits: 0~10 (○)

6~15 (Δ)

16 or more (X)

Uniform etching (excellent) ○-Δ-X (inferior) pitting corrosion

The following examples were described hereinafter to describe further in detail the alkaline cleaning agent according to the present invention and its method of using. These examples are merely illustrative and do not intend to limit at all the present invention.

The property of the cleaning liquids having the following components was confirmed using the cleaning liquids (1)~(13) prior to the application of operation load and the cleaning liquids (1')~(13') after the application of operation load.

Example 1

Cleaning Liquid (1)

Used Water: city water (in terms of metal ions) 0.027 g/L

Potassium Carbonate: 5.0 g/L

Hydroxyalkyldiphosphonic acid: 3.0 g/L

Tartaric acid: 2.0 g/L

Surfactant: 4.0 g/L

Calcium chloride (in terms of calcium): 0.01 g/L

Magnesium carbonate (in terms of magnesium): 0.01 g/L

TABLE 1

| | Organic Phosphonic Acid: Total Amount of Metal Ions | Organic Phosphonic Acid: Metal Ions |
|---|---|---|
| Cleaning Liquid (1) | 3 g/L:0.047 g/L | 100:1.2 |
| Cleaning Liquid (1') after Application of Operation Load | 3 g/L:0.077 g/L (Actual Analytical Value) | 100:2.6 |

Cleaning Liquid (1') after Application of Operation Load pH 10.5

Treating Conditions

Temperature: 50° C.

Method: Spraying

Time: 30 seconds

Used Water (1) In the case of city water→Total quantity of metal ions: 27.0 ppm (total quantity of Ca, Mg and Fe)

(2) In the case of deionized water→The total quantity of metal ions: 0.0 ppm

Example 2

Cleaning Liquid (2)

Used Water: deionized water (in terms of metal ions) 0.0 g/L

Potassium Hydroxide 0.5 g/L

Potassium Carbonate: 5.0 g/L

Hydroxyalkyldiphosphonic acid: 3.0 g/L

Formic acid: 5.0 g/L

Surfactant: 1.0 g/L

Potassium aluminate: 1.0 g/L

Iron sulfate (in terms of iron ions): 0.003 g/L

TABLE 2

| | Organic Phosphonic Acid: Total Amount of Metal Ions | Organic Phosphonic Acid: Metal Ions |
|---|---|---|
| Cleaning Liquid (2) | 3 g/L:0.003 g/L | 100:0.1 |
| Cleaning Liquid (2') after Application of Operation Load | 3 g/L:0.033 g/L (Actual Analytical Value) | 100:1.1 |

Cleaning Liquid (2') after Application of Operation Load pH 11.0

Treating Conditions

Temperature: 40° C.

Method: Spraying

Time: 50 seconds

Example 3

Cleaning Liquid (3)

Used Water: city water (in terms of metal ions) 0.027 g/L

Potassium Hydroxide: 1.0 g/L

Potassium Carbonate: 10.0 g/L

Hydroxyalkyldiphosphonic acid: 5.0 g/L

Acetic acid: 5.0 g/L

Surfactant: 6.0 g/L

Sodium aluminate: 2.0 g/L

Calcium carbonate (in terms of calcium): 0.2 g/L

Magnesium sulfate (in terms of magnesium): 0.3 g/L

TABLE 3

| | Organic Phosphonic Acid: Total Amount of Metal Ions | Organic Phosphonic Acid: Metal Ions |
|---|---|---|
| Cleaning Liquid (3) | 5 g/L:0.527 g/L | 100:10.5 |
| Cleaning Liquid (3') after Application of Operation Load | 5 g/L:0.557 g/L (Actual Analytical Value) | 100:11.1 |

Cleaning Liquid (3') after Application of Operation Load
pH 11.5
Treating Conditions
Temperature: 60° C.
Method: Spraying
Time: 60 seconds Example 4

Cleaning Liquid (4)

Used Water: city water (in terms of metal ions) 0.027 g/L

Potassium Hydroxide: 1.0 g/L

Potassium Carbonate: 10.0 g/L

Hydroxyalkyldiphosphonic acid: 5.0 g/L

Heptogluconic acid: 7.0 g/L

Surfactant: 6.0 g/L

Sodium aluminate 2.0 g/L

Manganese carbonate (in terms of manganese): 0.005 g/

TABLE 4

| | Organic Phosphonic Acid: Total Amount of Metal Ions | Organic Phosphonic Acid: Metal ions |
|---|---|---|
| Cleaning Liquid (4) | 5 g/L:0.032 g/L | 100:0.6 |
| Cleaning Liquid (4') after Application of Operation Load | 5 g/L:0.062 g/L (Actual Analytical Value) | 100:1.2 |

Cleaning Liquid (4') after Application of Operation Load
pH 12.5
Treating Conditions
Temperature: 40° C.
Method: Spraying
Time: 50 seconds Example 5

Cleaning Liquid (5)

Used Water: deionized water (in terms of metal ions) 0.0 g/L

Potassium Hydroxide 1.0 g/L

Potassium Carbonate: 10.0 g/L

Hydroxyalkyldiphosphonic acid: 4.5 g/L

Malonic acid: 2.0 g/L

Surfactant: 8.0 g/L

Calcium nitrate (in terms of calcium): 0.08 g/L

TABLE 5

| | Organic Phosphonic Acid: Total Amount of Metal Ions | Organic Phosphonic Acid: Metal Ions |
|---|---|---|
| Cleaning Liquid (5) | 5 g/L:0.08 g/L | 100:1.6 |
| Cleaning Liquid (5') after Application of Operation Load | 5 g/L:0.11 g/L (Actual Analytical Value) | 100:2.2 |

Cleaning Liquid (5') after Application of Operation Load
pH 11.5
Treating Conditions
Temperature: 60° C.
Method: Spraying
Time: 100 seconds Example 6

Cleaning Liquid (6)

Used Water: deionized water (in terms of metal ions) 0.0 g/L

Potassium Hydroxide: 1.0 g/L

Potassium Carbonate: 10.0 g/L

Hydroxyalkyldiphosphonic acid: 5.0 g/L

Glutaric acid: 8.0 g/L

Surfactant: 3.0 g/L

Sodium aluminate: 3.0 g/L

Manganese sulfate (in terms of maganese): 0.5 g/L

TABLE 6

| | Organic Phosphonic Acid: Total Amount of Metal Ions | Organic Phosphonic Acid: Metal Ions |
|---|---|---|
| Cleaning Liquid (6) | 5 g/L:0.5 g/L | 100:10.0 |
| Cleaning Liquid (6') after Application of Operation Load | 5 g/L:0.53 g/L (Actual Analytical Value) | 100:10.6 |

Cleaning Liquid (6') after Application of Operation Load pH 10.6

Treating Conditions

Temperature: 60° C.

Method: Spraying

Time: 50 seconds

Example 7

Cleaning Liquid (7)

Used Water: city water (in terms of metal ions) 0.027 g/L

Potassium hydroxide: 1.0 g/L

Potassium carbonate: 10.0 g/L

Hydroxyalkyldiphosphonic acid: 7.0 g/L

Heptogluconic acid: 0.5 g/L

Surfactant: 1.0 g/L

Iron sulfate (in terms of iron): 0.1 g/L

Magnesium sulfate (in terms of magnesium): 0.1 g/L

TABLE 7

| | Organic Phosphonic Acid: Total Amount of Metal Ions | Organic Phosphonic Acid: Metal Ions |
|---|---|---|
| Cleaning Liquid (7) | 7 g/L:0.227 g/L | 100:3.2 |
| Cleaning Liquid (7') after Application of Operation Load | 7 g/L:0.257 g/L (Actual Analytical Value) | 100:3.7 |

Cleaning Liquid (7') after Application of Operation Load pH 11.0

Treating Conditions

Temperature: 60° C.

Method: Spraying

Time: 50 seconds

Example 8

Cleaning Liquid (8)

Used Water: city water (in terms of metal ions) 0.027 g/L

Sodium metasilicate: 0.1 g/L

Sodium phosphate: 1.0 g/L

Hydroxyalkyldiphosphonic acid: 9.0 g/L

Oxalic acid: 5.0 g/L

Surfactant: 6.0 g/L

Sodium aluminate 3.0 g/L

Magnesium sulfate (in terms of magnesium): 0.2 g/L

TABLE 8

| | Organic Phosphonic Acid: Total Amount of Metal Ions | Organic Phosphonic Acid: Metal Ions |
|---|---|---|
| Cleaning Liquid (8) | 9 g/L:0.227 g/L | 100:2.5 |
| Cleaning Liquid (8') after Application of Operation Load | 9 g/L:0.257 g/L (Actual Analytical Value) | 100:2.9 |

Cleaning Liquid (8') after Application of Operation Load pH 13.0

Treating Conditions

Temperature: 70° C.

Method: Spraying

Time: 5 seconds

Comparative Example 1

Cleaning Liquid (9)

Used Water: deionized water (in terms of metal ions) 0.0 g/L

Potassium Hydroxide: 0.5 g/L

Potassium Carbonate: 5.0 g/L

Hydroxyalkyldiphosphonic acid: 3.0 g/L

Heptogluconic acid: 3.0 g/L

Surfactant: 3.0 g/L

TABLE 9

| | Organic Phosphonic Acid: Total Amount of Metal Ions | Organic Phosphonic Acid: Metal Ions |
|---|---|---|
| Cleaning Liquid (9) | 3 g/L:0 g/L | 100:0 |
| Cleaning Liquid (9') after Application of Operation Load | 3 g/L:0.03 g/L (Actual Analytical Value) | 100:0.6 |

Cleaning Liquid (9') after Application of Operation Load
pH 11.0
Treating Conditions
Temperature: 50° C.
Method: Spraying
Time: 30 seconds Comparative Example 2

Cleaning Liquid (10)

Used Water: city water (in terms of metal ions) 0.027 g/L

Potassium Hydroxide: 1.0 g/L

Potassium Carbonate: 5.0 g/L

Hydroxyalkyldiphosphonic acid: 0.0 g/L

Benzoic acid: 0.5 g/L

Surfactant: 6.0 g/L

Manganese sulfate (in terms of manganese): 0.3 g/L

Magnesium carbonate (in terms of magnesium): 0.3 g/L

TABLE 10

| | Organic Phosphonic Acid: Total Amount of Metal Ions | Organic Phosphonic Acid: Metal Ions |
|---|---|---|
| Cleaning Liquid (10) | 0 g/L:0.627 g/L | 100:∞ |
| Cleaning Liquid (10') after Application of Operation Load | 3 g/L:0.657 g/L (Actual Analytical Value) | 100:∞ |

Cleaning Liquid (10') after Application of Operation Load
pH 11.5
Treating Conditions
Temperature: 50° C.
Method: Spraying
Time: 70 seconds Comparative Example 3

Cleaning Liquid (11)

Used Water: deionized water (in terms of metal ions) 0.0 g/L

Potassium hydroxide 0.6 g/L

Potassium carbonate: 5.0 g/L

Hydroxyalkyldiphosphonic acid: 0.2 g/L

Gluconic acid: 3.0 g/L

Surfactant: 3.0 g/L

Calcium chloride (in terms of calcium): 0.02 g/L

Iron sulfate (in terms of iron): 0.02 g/L

TABLE 11

| | Organic Phosphonic Acid: Total Amount of Metal Ions | Organic Phosphonic Acid: Metal Ions |
|---|---|---|
| Cleaning Liquid (11) | 0.2 g/L:0.040 g/L | 100:20 |
| Cleaning Liquid (11') after Application of Operation Load | 0.2 g/L:0.075 g/L (Actual Analytical Value) | 100:37.5 |

Cleaning Liquid (11') after Application of Operation Load
pH 12.0
Treating Conditions
Temperature: 40° C.
Method: Spraying
Time: 100 seconds Comparative Example 4

Cleaning Liquid (12)

Used Water: deionized water (in terms of metal ions) 0.0 g/L

Potassium hydroxide: 0.5 g/L

Potassium Carbonate: 5.0 g/L

Hydroxyalkyldiphosphonic acid: 3.0 g/L

Propionic acid: 1.0 g/L

Surfactant: 2.0 g/L

Sodium aluminate: 1.0 g/L

Calcium nitrate (in terms of calcium): 0.05 g/L

TABLE 12

| | Organic Phosphonic Acid: Total Amount of Metal Ions | Organic Phosphonic Acid: Metal Ions |
|---|---|---|
| Cleaning Liquid (12) | 3 g/L:0.05 g/L | 100:1.6 |
| Cleaning Liquid (12') after Application of Operation Load | 3 g/L:0.08 g/L (Actual Analytical Value) | 100:2.7 |

Cleaning Liquid (12') after Application of Operation Load
pH 13.5
Treating Conditions
Temperature: 60° C.
Method: Spraying
Time: 20 seconds Comparative Example 5

Acidic Detergent Agent, CL-L450, product of Nihon Parkerizing Co., Ltd.

pH: 1.0

Treating Condition

Temperature: 50° C.

Method: Spraying

Time: 50 seconds

The evaluation results of Examples 1 through 8, Comparative Examples 1 through 5, as well as Cleaning Liquid (1) through (13) are shown in Table 13.

TABLE 13

| | Cleaning Liquid | Effects | | | | |
|---|---|---|---|---|---|---|
| | | Smut Removal | Water Wettability (%) | Adhesiveness of Paint Coating | Retention Appearance | Etching Uniformity |
| Example | 1 | ○ | 100 | ○ | ○ | ○ |
| | 2 | ○ | 100 | ○ | ○ | ○ |
| | 3 | ○ | 100 | ○ | ○ | ○ |
| | 4 | ○ | 100 | ○ | ○ | ○ |
| | 5 | ○ | 100 | ○ | ○ | ○ |
| | 6 | ○ | 100 | ○ | ○ | ○ |
| | 7 | ○ | 100 | ○ | ○ | ○ |
| | 8 | ○ | 100 | ○ | ○ | ○ |
| Comparative Example | 9 | ○ | 100 | X | X | X |
| | 10 | X | 5 | X | X | X |
| | 11 | ○ | 100 | ○ | ○ | ○ |
| | 12 | ○ | 100 | ○ | X | X |
| | 13 | ○ | 100 | ○ | ○ | ○ |

The evaluation results of Examples 1 through 8, Comparative Examples 1 through 5, as well as Cleaning Liquid (1') through (13') are shown in Table 14.

TABLE 14

| | Cleaning Liquid | Effects | | | | |
|---|---|---|---|---|---|---|
| | | Smut Removal | Water Wettability (%) | Adhesiveness of Paint Coating | Retention Appearance | Etching Uniformity |
| Example | 1' | ○ | 100 | ○ | ○ | ○ |
| | 2' | ○ | 100 | ○ | ○ | ○ |
| | 3' | ○ | 100 | ○ | ○ | ○ |
| | 4' | ○ | 100 | ○ | ○ | ○ |
| | 5' | ○ | 100 | ○ | ○ | ○ |
| | 6' | ○ | 100 | ○ | ○ | ○ |
| | 7' | ○ | 100 | ○ | ○ | ○ |
| | 8' | ○ | 100 | ○ | ○ | ○ |
| Comparative Example | 9' | ○ | 100 | ○ | ○ | ○ |
| | 10' | X | 5 | X | X | X |
| | 11' | X | 30 | X | X | X |
| | 12' | ○ | 100 | ○ | X | X |
| | 13' | — | — | — | — | — |

As is apparent from the results of Tables 13 and 14, the alkaline cleaning agents according to the present invention, shown in the Cleaning Liquids (1) through (13) and (1') through (13') described in Examples 1 through 8, are improved in every property of smut removal, water wettability, paint-coating adhesiveness, retention appearance and etching uniformity and exhibits properties equal or superior to those of the acidic detergent agent of the comparative example. The cleaning liquid (9) of Comparative Example 1, which is free of a metal ion having from 5.0 to 14.0 of stability constant with organic phosphonic acid and its salt, is poor in the paint coating adherence, retention appearance and etching uniformity. However, the cleaning liquid (9') is improved in all of the properties, because an appropriate amount of the alloying elements is dissolved in the dissolving process such that the ratio of the metallic ions and organic phosphonic ions falls within an appropriate range. Comparative Example 2 is poor in all of the properties, since neither organic phosphonic acid nor its salt is blended in this comparative example 2. Comparative Example 3 is also poor in all of the properties, since the blended amount of the metal ions relative to organic phosphonate is excessive. In Comparative Example 4, metal ions, which have from 5.0 to 14.0 of stability constant with respect to the organic phosphonic acid or its salt, are blended within an appropriate range. However, Comparative Example 4 is poor in the retention appearance and etching uniformity, since pH exceeds the upper limit.

INDUSTRIAL APPLICABILITY

The alkaline cleaning liquid and the cleaning method according to the present invention is improved in etching uniformity of the aluminum surface, and can achieve solutions to various practical problems, such as the line retention and pitting corrosion. Although such problems as maintenance, treating of waste water and operation are involved in the acid cleaning, the properties of the present invention are excellent to overcome these problems.

Figure 1:
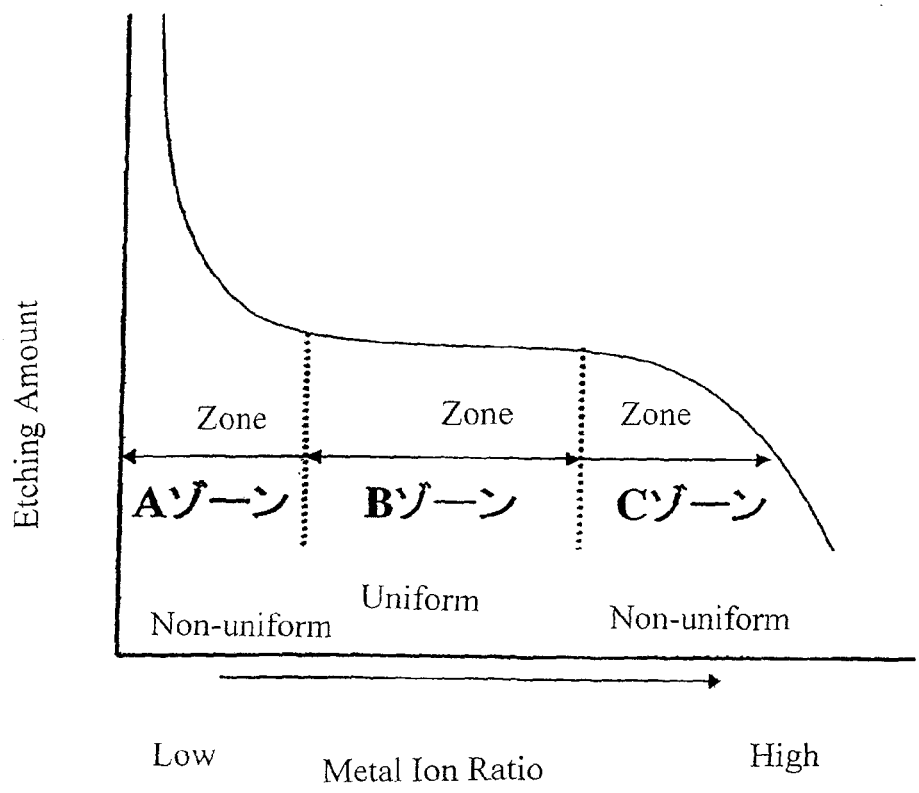
FIG. 1 indicates relationship between the metal ion ratio (abscissa) and the etching amount (ordinate) and illustrates an example of the washing liquid according to the present claim 2.

The invention claimed is:

1. A method for alkaline cleaning of aluminum or aluminum alloy, characterized in that an alkaline cleaning liquid is prepared by mixing into deionized water or water which contains one or more metallic ions selected from Ca, Mg, Mn, Fe, Zn and Cu, the following ingredients (A)-(D):

(A) from 0.2 to 10 g/L of one or more of organic phosphonic acid and its salts, (B) from 0.001 to 2 g/L of one or more metallic ions selected from Ca, Mg, Mn, Fe, Zn and Cu in terms of a total concentration contained in said alkaline cleaning liquid, (C) from 0.5 to 40 g/L in total of one or more alkali builders selected from alkali metal hydroxide, alkali metal carbonate, inorganic alkali metal phosphate and alkali metal silicate, and (D) from 0.1 to 10 g/L of surfactant, and is further characterized in that said alkaline cleaning liquid is brought into contact with the aluminum or aluminum alloy at a temperature of from 30° to 70° C. for 2 to 120 seconds, while maintaining a weight ratio of said organic phosphonic acid and its salts to one or more of metallic ions contained in the alkaline cleaning liquid selected from Ca, Mg, Mn, Fe, Zn and Cu within a range of from 100:0.05 to 20 and subsequently rinsing with water.

2. The method according to claim 1, characterized in that the alkaline cleaning liquid further contains from 0.1 to 10.0 g/L of one or more chelating agents, selected from the group consisting of gluconic acid, heptogluconic acid, glycolic acid, oxalic acid, citric acid, tartaric acid, malonic acid, formic acid, glutaric acid, propyonic acid, succinic acid, malic acid, lactic acid, acetic acid, and benzoic acid.

3. The method according to claim 1, characterized in that 60% or more of said alkali metal hydroxide and alkali metal carbonate in terms of alkali metal mole ratio is potassium.

4. The method according to claim 1, wherein a pH of said alkaline cleaning liquid is in the range of from 9.0 to 13.0.

5. The method according to claim 1, wherein said one or more metallic ions include 0.01 g/L or more of Ca.

6. The method according to claim 1, wherein said one or more metallic ions include 0.003 g/L or more of Fe.

7. The method according to claim 1, wherein said one or more metallic ions include 0.01 g/L or more of Mg.

8. The method according to claim 1, wherein said one or more metallic ions include 0.005 g/L or more of Mn.

* * * * *

UNITED STATES PATENT AND TRADEMARK OFFICE

CERTIFICATE OF CORRECTION

PATENT NO. : 7,709,435 B2
APPLICATION NO. : 10/569495
DATED : May 4, 2010
INVENTOR(S) : Kazuya Hino et al.

It is certified that error appears in the above-identified patent and that said Letters Patent is hereby corrected as shown below:

ON THE TITLE PAGE:

Item (73) Assignees, correct the identification of the Assignees as follows:

Change

"Nihon Parkerizing Co., Ltd., Tokyo (JP), Tokyo Seikan Kaisha Ltd., Tokyo (JP)"

to

--Nihon Parkerizing Co., Ltd., Tokyo (JP), Toyo Seikan Kaisha Ltd., Tokyo (JP)--.

Signed and Sealed this
Twenty-ninth Day of March, 2011

David J. Kappos

David J. Kappos
*Director of the United States Patent and Trademark Office*